United States Patent [19]

Seliskar et al.

[11] 4,189,058

[45] Feb. 19, 1980

[54] FLOATING THERMALLY INSULATING TANK COVERS

[75] Inventors: James T. Seliskar, Midland; Donald C. Adams, Freeland, both of Mich.

[73] Assignee: The Dow Chemical Company, Midland, Mich.

[21] Appl. No.: 885,845

[22] Filed: Mar. 13, 1978

[51] Int. Cl.[2] ..... B65D 87/20

[52] U.S. Cl. ..... 220/218; 220/227

[58] Field of Search ..... 220/216, 218, 227, 4 B, 220/4 E; 4/172.12

[56] References Cited

U.S. PATENT DOCUMENTS

| | | | |
|---|---|---|---|
| 414,561 | 11/1889 | Mallery | 220/216 |
| 1,674,039 | 6/1928 | Glass | 220/218 |
| 1,717,100 | 6/1929 | Downes | 220/216 |
| 2,919,047 | 12/1959 | Fino | 220/216 |
| 3,419,174 | 12/1968 | Engdahl | 220/216 |
| 3,462,040 | 8/1969 | Galloway | 220/216 |
| 3,910,452 | 10/1975 | Szasz | 220/216 |

FOREIGN PATENT DOCUMENTS

| | | | |
|---|---|---|---|
| 291618 | 6/1928 | United Kingdom | 220/216 |

*Primary Examiner*—Joseph Man-Fu Moy
*Attorney, Agent, or Firm*—R. B. Ingraham

[57] ABSTRACT

Open top tanks or ponds are provided with a thermally insulating floating cover which comprises a plurality of individual generally flat polygonal plates floating in edge-to-edge relationship. Each of the plates has at least one peripherally disposed downwardly projecting flange and means to vent gases from beneath the plate-like element.

8 Claims, 7 Drawing Figures

FLOATING THERMALLY INSULATING TANK COVERS

Oftentimes, open top tanks or ponds are employed for the storage of aqueous solutions or dispersions such as brine and the like. Generally, such tanks or ponds are subjected to substantial evaporation in warm, dry, windy weather and freezing in winter weather. Generally, such open top tanks in the wintertime are heated and oftentimes agitated to prevent freezing and to maintain their contents at a desirable often above ambient temperature. Many floating and thermally insulating covers have been designed for such tanks or ponds. One such variety is disclosed in U.S. Pat. No. 3,462,040 wherein a plurality of foam panels are coated with cement to provide a weather-resistant surface and have a downwardly dependent flange for no stated reason. A number of floating covers have been designed for closed tanks wherein the cover floats within the tank for the primary purpose of reducing evaporation. Liquids have been prevented from evaporating in open top tanks by the use of various polygonal floating bodies which tend to nest and position themselves in a closed packed pattern. Floating spheres have also been employed. One of the greater difficulties with the use of panels or smaller-shaped bodies is their resistance to wind. With no wind or relatively light wind, such bodies will pack or distribute themselves usually in a uniform manner over the surface of the liquid to be covered. However, as the velocity of the wind increases, the floating bodies tend to be displaced and are pushed one upon the other leaving substantial and significant areas of the liquid surface exposed. As the force of the wind increases, oftentimes such floating panels or shaped bodies are blown from the tank.

It would be desirable if there were available an improved insulating and covering means for liquid bodies such as open top tanks or ponds.

It would also be desirable if there were available an improved thermally insulating and wind-resistant covering means for open top tanks or ponds which could be readily fabricated at moderate cost.

It would also be desirable if there were available an improved covering means for open top tanks or ponds which would readily adapt or could be adapted to tanks or ponds of various sizes and shapes with minimal effort.

It would also be beneficial if there were an improved method for the protection of liquids in open top tanks or ponds.

These benefits and other advantages in accordance with the present invention are achieved in an improved liquid body covering element adapted to be disposed in edge-to-edge relationship with generally like elements to cover at least a major portion of body of liquid, the improved element comprising a first, thermally insulating generally plate-like member having two major generally parallel surfaces, a periphery, a flange disposed about the periphery of the member, the flange being generally normal to the major surfaces, the tank covering element being adapted to be disposed flange downwardly on a surface of liquid within a tank, vent means adapted to vent gases from a space enclosed by the flange and the plate-like member and an adjacent liquid body to a space adjacent a major face of the plate-like member remote from the face adjacent the flange, with the further limitation that the covering element floats on a liquid which it is intended to cover and the element is not readily removed from the liquid by wind.

Further features and advantages of the present invention will become more apparent from the following specification taken in connection with the drawing wherein.

Figure 1:
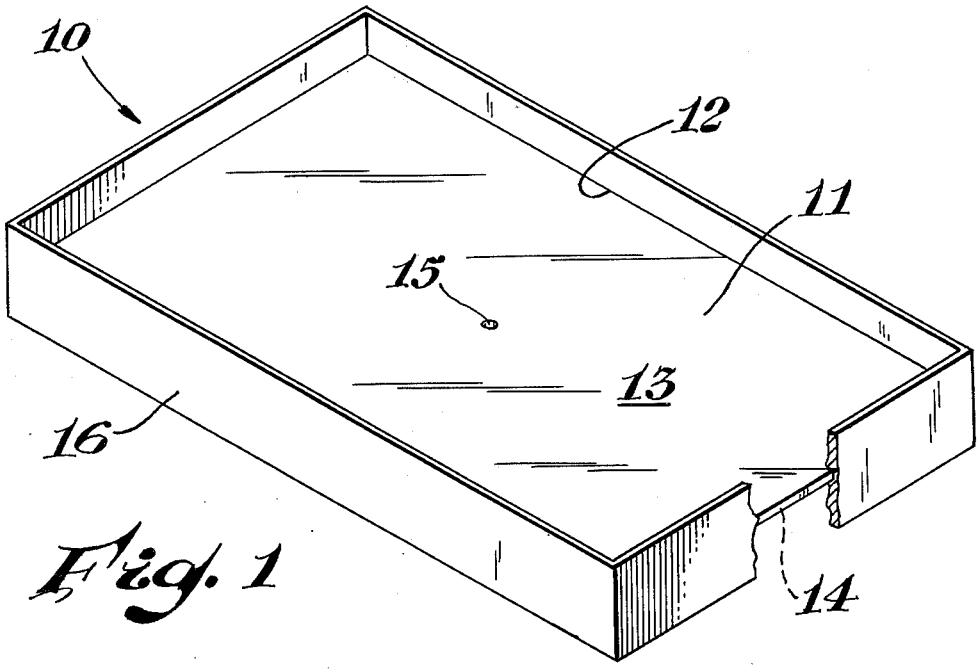
FIG. 1 is a schematic isometric representation of a liquid body covering element in accordance with the present invention.
Figure 2:
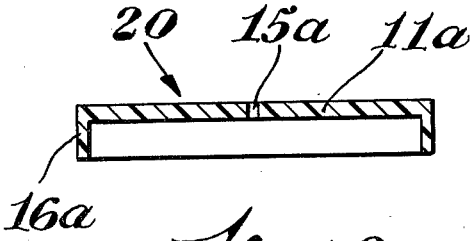
FIG. 2 is a sectional view of an alternate embodiment of the invention.
Figure 6:
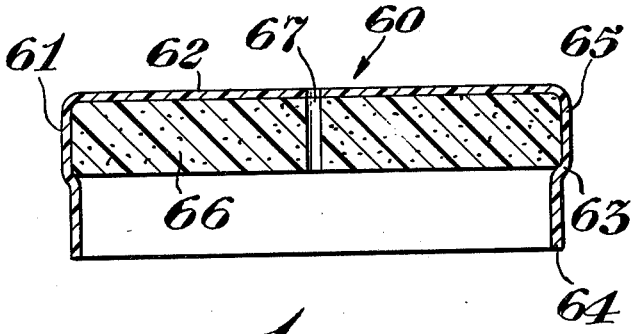
Figure 3:
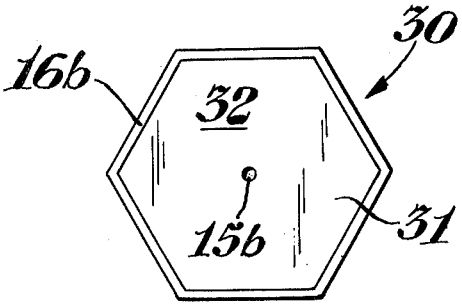
FIG. 3 is a plan view of a third embodiment of the invention.
Figure 7:
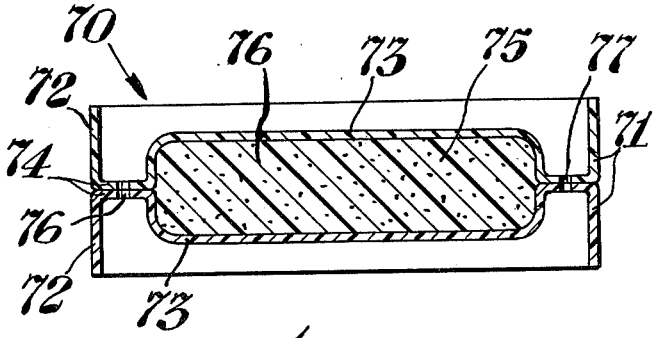
Figure 4:
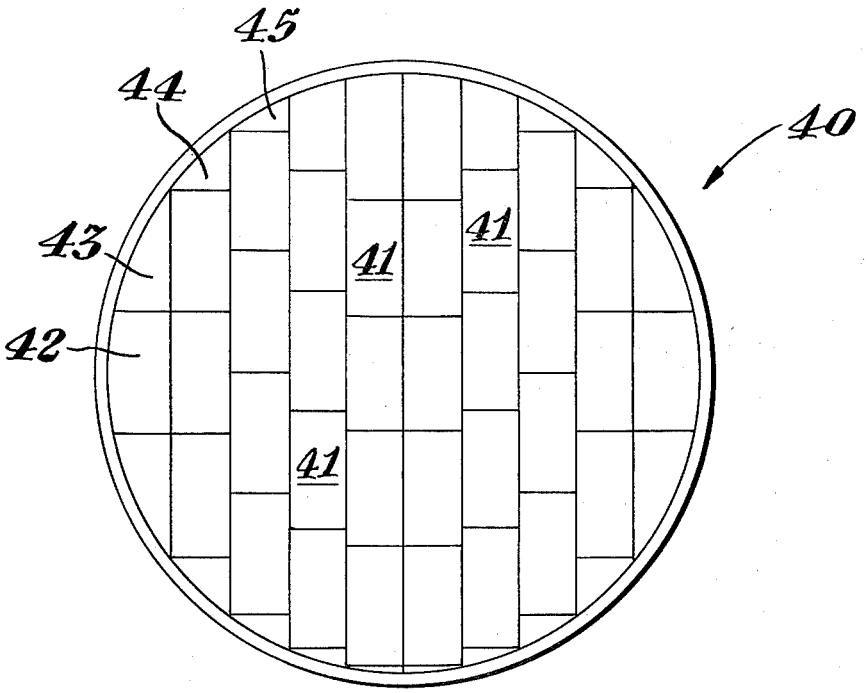
Figure 5:
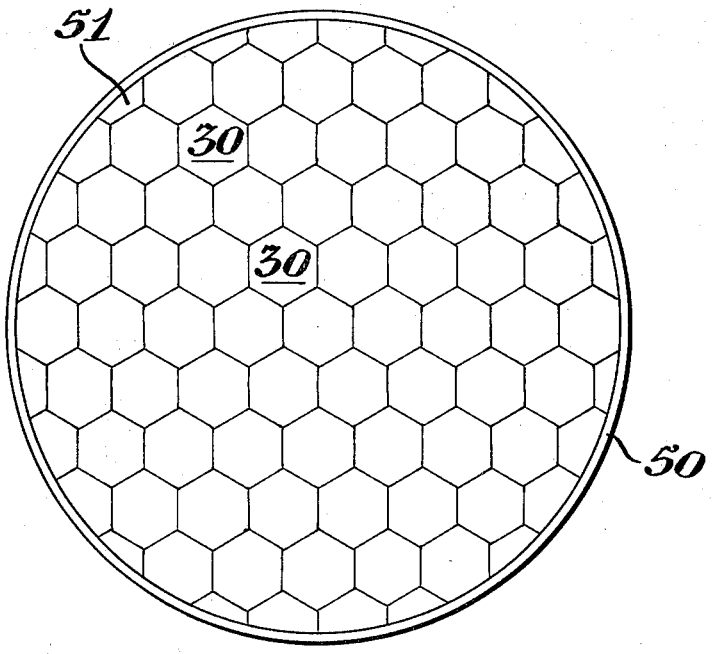

FIG. 4 schematically depicts one arrangement of elements in accordance with FIGS. 1 and 2 arranged on a liquid body contained in a cylindrical open top tank;

FIG. 5 schematically depicts the arrangement of elements in accordance with FIG. 3 in an open top tank; and FIGS. 6 and 7 are cross-sectional views of alternate embodiments of the invention.

In FIG. 1 there is schematically depicted a covering element in accordance with the present invention generally designated by the reference numeral 10. The covering element 10 comprises a generally plate-like body member or element 11 having the configuration of a regular polygon and more specifically a rectangle. The element 11 has a periphery 12 extending entirely thereabout, a first major face 13 and a second major face 14. A gas passage or vent 15 is generally centrally disposed within the plate-like body member 11 and permits the passage of gas from one major face to the other. Disposed about and affixed to the periphery 12 of the plate-like body element 11 is a flange 16. The flange 16 extends in a direction generally normal to the major faces 13 and 14 of the plate-like member 11 and is generally symmetrically disposed about the plane of the member 11.

In FIG. 2 there is depicted a sectional view of an alternate embodiment of the invention generally indicated by the reference numeral 20. The liquid covering element 20 comprises a generally planar sheet-like body **11*a* having the general configuration of the element 11 of FIG. 1. A vent 15*a* is disposed within the body 11*a*. Peripherally disposed about the body 11*a* and affixed thereto is a continuous dependent flange 16*a*. The flange 16*a* differs from the flange 16 in that it encloses only one face of the generally planar body 11*a***.

A plan view of a third embodiment of the invention is depicted in FIG. 3 and is indicated by the reference numeral 30. The element 30 has a plate-like body member 31 having a hexagonal configuration. The plate-like member 31 has a vent **15*b* disposed therein and is functionally equivalent to vents 15 and 15*a* of FIGS. 1 and 2, respectively. A dependent flange 16*b* encloses a visible major face 32 of the plate-like element 31**.

Beneficially, liquid or tank covering elements of FIGS. 1, 2 or 3 are readily fabricated from appropriate materials such as closed-cell expanded synthetic resinous foam, for example, closed-cell polyolefin foam such as polyethylene, polypropylene, foamed polymers of resinous ethylene-propylene copolymers as well as foamed polystyrene and foamed styrene copolymers, wood, sheet metal and the like. Generally, it is desirable to fabricate the generally planar elements such as elements 11, **11*a* and 31 from a closed-cell foam polystyrene, for example, foamed polystyrene sheet having a thickness of about 2 inches, it being recognized that the thickness of the foam selected will be dependent upon the insulating value desired and the mechanical strength required in fabrication as well as in final application. Generally, it is desirable to employ a foam polystyrene having a thickness of about 2 inches when tank cover segments such as those in FIGS. 1 and 2 having dimensions of 4 ft. by 4 ft. up to 4 ft. by about 8 ft. are employed. Beneficially, the flanges 16, 16***a* and 16*b* are fabricated from a resilient material such as high-density closed-cell foam polyethylene or similar material which resists abrasion caused by relative motion between adjacent insulating elements disposed within a tank. In fabricating insulating members in accordance with the present invention, oftentimes it is desirable when employing a foamed polystyrene member such as the member 11 and foamed polyethylene flanges such as the flange 16 to abrade the surface of the flange material to form open foam cells on the surface thereof. The polyolefin foam flanges may be then readily adhered to the foam polystyrene member such as the member 11 by the use of conventional adhesives such as epoxy resins. Generally for such an assembly, it is desirable to employ a jig which may be readily assembled from wood. The embodiments of FIGS. 1, 2 and 3 are readily assembled employing such a technique. The surface of the insulating element which is to be disposed uppermost must, if of an organic material and if intended for outdoor service over an extended period of time, be protected from the sun as ultraviolet radiation causes degradation of most organic substances. Such protection is readily obtained employing a coat of Portland cement, pigmented acrylic latex mastic, metal foil or like foam protective coatings well known in the art. Tank or liquid cover elements in accordance with the invention may be prepared in an alternative manner by affixing the flanges to the central sheet by means of a plurality of headed skewers, for example, stainless steel nails forced through the outer face of the flanges such as the flange 16 into the element 11. Desirably, adjacent skewers should lie in the plane of the element 11 and be disposed at about 90° to each other. When employing skewers, generally there is sufficent leakage between the periphery of the plate-like element such as the element 11 and the flange such as the flange 16 that it is oftentimes unnecessary to provide a preformed vent such as the vent 16. A preferred construction technique is the use of hardenable adhesives such as epoxy resins, however, if cover members are desired rapidly, wooden dowel can be cut to lengths, for example five-inch lengths, one end pointed and two of such skewers employed at about 90° to each other in the hereinbefore described manner to affix, at desired intervals, a flange such as the flange 16 to a generally plate-like element such as the element 11.

FIG. 4 is a plan view of an open top tank generally designated by the reference numeral 40. The tank 40 has disposed therein a plurality of floating insulating elements generally designated by the reference numeral 41. The elements 41 are similar in construction to the elements 10 or 20 of FIGS. 1 and 2, respectively. On the surface of the liquid, not shown, within the tank 40 are disposed portions of insulating elements designated by the reference numerals 42, 43, 44 and 45. The elements 42, 43, 44 and 45 are portions of elements such as elements which have been cut with a saw and have flanges on the curved portion thereof but have been fitted to substantially cover the surface of the liquid within the tank.

In FIG. 5 there is depicted a tank 50 having disposed therein a plurality of elements 30 of hexagonal configuration. The elements 30 are in essentially a hexagonal closed-packed configuration and cover a large portion of the surface of a liquid designated by the reference numeral 51 contained within the tank 50.

In FIG. 6 there is schematically depicted a sectional view of alternate embodiment of the invention generally designated by the reference numeral 60. The embodiment 60 comprises a flanged open-bottomed pan 61 of generally rectangular configuration. The pan 61 has a top 62 and a circumferential dependent flange 63. The flange 63 has an edge portion 64 remote from the top 62. The portion 64 is slightly smaller in circumference than is a flange portion 65 adjacent the top 62. A closed-cell foam body 66 of generally rectangular configuration is disposed within the flange portion 65 and is maintained in position frictionally by the flange portion 64. A vent 67 is generally centrally disposed and defined by the foam body 66 and the adjacent portion of the top 62. Beneficially, insulating elements such as the elements 60 are readily formed by vacuum forming a thermoplastic resinous sheet, for example, polyethylene, to form the pan or container 61. A synthetic resinous foam such as closed-cell polystyrene foam or polyethylene foam is then forced into the pan so that it is frictionally retained therein and the vent such as the vent 67 formed by drilling, punching or perforating with a hot probe. In order to achieve adequate weather resistance, the pan 61 should be formed of metal or polyethylene polypropylene or like polymer containing 5 to 10 percent by weight of carbon black.

In FIG. 7 there is depicted an alternate insulation element in accordance with the present invention generally designated by the reference numeral 70. The embodiment 70, in essence, comprises two identical rectangular pans 71, the pans 71 having a peripheral flange 72, raised bottoms 73 and a lower or annular bottom region 74 disposed between the raised bottoms 73 and the flange 72. The pans 71 beneficially are prepared of like material to that employed for the pan 61 of FIG. 6. The pans 71 are joined to each other along their annular peripheral bottom portions 74. The raised bottoms 73 define a space 75 which if desired can contain a foamed closed-cell foam flotation body 76, beneficially of closed-cell polystyrene or polyethylene foam. The joined annular bottoms 74 are perforated to form vent passages 77.

The embodiment of the present invention depicted in FIG. 1 is particularly advantageous when it is necessary to apply insulating elements to a tank having a liquid level below the top of the tank a sufficient distance that positioning of the element is difficult. Insulating elements such as the elements 10 are symmetrical about the planar element 11 and can be thrown into the tank, settle on either side and the element has a downward projecting flange.

The embodiment of FIG. 2 is preferred where one has ready access to the surface of the liquid and can easily position the insulating elements 20, flange downwardly on the surface of the liquid.

The embodiment of FIG. 3 is particularly desirable where total coverage of the liquid is not essential and minimum cutting and fitting of insulating elements is desired.

The embodiments of FIGS. 2 and 3 are preferred for locations which are subject to exceptionally high winds, as there are no upwardly projecting flanges which will give rise to forces generally in the plane of the upper surface of the liquid.

The embodiments of FIGS. 6 and 7 are particularly desirable where high-speed fabrication is required. Pans such as the pans 61 and 71 of FIGS. 6 and 7 can be vacuum-formed from synthetic resinous thermoplastic sheet rapidly and in the embodiment of FIG. 6 all that is required is the insertion of the foam and perforation of the vent hole eliminating the necessity for coatings and adhesives that may require substantial amount of time to harden. The embodiment of FIG. 7 is prepared in a somewhat similar manner. After preparation of the pans 71, the foam body 76 is placed in the raised bottom of the inverted pan 71, a second pan 71 placed thereover and the annular bottoms which are in contact are heat-sealed to one another. Vent passages such as the passages 76 are readily formed by perforating with a hot probe or drill.

Insulating members in accordance with the present invention are very resistant to wind in contrast to flat unflanged panels which are readily lifted from a body of water by wind gusts. Generally, the vents such as the vents 15, 15*a* and 15*b* may be in the order of 0.2 square inch per 32 square ft. of the panel, that is a ½ inch diameter hole in a 4 ft. by 8 ft. insulating element such as the element 11 of FIG. 1 is satisfactory. When the insulating element is placed on the surface of the water or other liquid, the air, trapped between the adjacent major face of the planar element, the flange and the liquid, is forced through the vent 15 rather slowly; the liquid then contacts the adjacent major face of the planar element. However, when a gust of wind attempts to lift an insulating element in accordance with the invention such as the element 10, it must lift not only the element 10 but much of the water within the space enclosed by the flange 16 on the plate-like element 11. An insulating element such as the element 10 can readily be removed from the surface of the water with a slow gentle force exceeding the weight of the insulating element but a much greater force must be applied to rapidly lift the insulating element from the water.

The dimensions of insulating members in accordance with the present invention will depend primarily on the particular tank or surface of liquid to be protected. Panels for many applications should not be larger than 4 ft. by 8 ft. as they can be very difficult to handle in the wind during installation and generally two people are required to manage such an insulating member. Insulating members 4 ft. by 4 ft. usually are most convenient for most installations. If there is substantial difference in the temperature between the atmosphere and the temperature of the tank liquid, 4 ft. by 8 ft. panels prepared with 2-inch polyethylene foam flanges on each side and 2-inch thick polystyrene foam flotation bodies (configuration of FIG. 1) show a marked tendency to warp, concave up, with a temperature difference of 120° F. between the liquid in the tank and the atmosphere, the liquid in the tank being at the higher temperature. Such warping due to thermal effects does not appear to affect the performance of the insulating elements.

The dimensions of the flanges of the insulating member in accordance with the invention will vary with the requirements for the particular installation. The more severe the anticipated wind conditions, the larger flange will be required. Small panels in general require smaller flanges than do large panels, for example, a 4 ft. by 8 ft. panel employing a two-inch flange will be removed by wind from the surface of a liquid in the event of wave action sufficient to raise the windward end of the panel from the water while under like conditions a two-inch flange on a 4 ft. by 4 ft. panel would be adequate and satisfactory. The selection of the most economical flange dimension is entirely dependent on local conditions.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. An improved liquid body covering element adapted to be disposed in edge-to-edge relationship with generally like elements to cover at least a major portion of a body of liquid, the improved element comprising a first, thermally insulating generally plate-like member having two major generally parallel surfaces, a periphery, a flange disposed about the periphery of the member the plate-like member being of close cell plastic foam, the flange being generally normal to the major surfaces the flange being a material which resists abrasion caused by relative motion between adjacent elements, the tank covering element being adapted to be disposed flange downwardly on a surface of liquid within a tank, vent means adapted to vent gases from a space enclosed by the flange and the plate-like member and an adjacent liquid body to a space adjacent a major face of the plate-like member remote from the face adjacent the flange, with the further limitation that the covering element floats on a liquid which it is intended to cover and the element is not readily removed from the liquid by wind.

2. The element of claim 1 wherein the flange is an abrasion-resistant plastic foam.

3. The element of claim 1 wherein the flange is generally symmetrically disposed about the plane of the plate-like member.

4. The element of claim 1 wherein the element has a generally rectangular configuration.

5. The element of claim 1 having a generally hexagonal configuration.

6. The element of claim 1 wherein the plate-like member is disposed within the flange.

7. An improved liquid body covering element adapted to be disposed in edge-to-edge relationship with generally like elements to cover at least a major portion of body of liquid, the improved element comprising a first, thermally insulating generally plate-like member having two major generally parallel surfaces, a periphery, a flange disposed about the periphery of the member, the flange being generally normal to the major surfaces, the tank covering element being adapted to be disposed flange downwardly on a surface of liquid within a tank, vent means adapted to vent gases from a space enclosed by the flange and the plate-like member and an adjacent liquid body to a space adjacent a major face of the plate-like member remote from the face adjacent the flange the element comprises generally identical rectangular pans, pans having a peripheral flange and raised bottoms, a lower and annular bottom region disposed between the raised bottom and the flange, the pans being in bottom-to-bottom sealed engagement, the joined annular bottom being perforated to form at least one vent passage, with the further limitation that the covering element floats on a liquid which it is intended to cover and the element is not readily removed from the liquid by wind.

8. The element of claim 7 having a closed-cell foam disposed beteen the raised bottoms.

* * * * *